United States Patent [19]

Ueda

[11] 4,200,242

[45] Apr. 29, 1980

[54] LINER IN GRINDING MILL

[75] Inventor: Hiroshi Ueda, Kobe, Japan

[73] Assignee: Kawasaki Jukogyo Kabushiki Kaisha, Kobe, Japan

[21] Appl. No.: 943,218

[22] Filed: Sep. 18, 1978

[30] Foreign Application Priority Data

May 29, 1978 [JP] Japan ..... 55-73228

[51] Int. Cl.[2] ..... B02C 17/22

[52] U.S. Cl. ..... 241/183

[58] Field of Search ..... 241/181-183, 241/284

[56] References Cited

U.S. PATENT DOCUMENTS 1,741,604 12/1929 Barratt ..... 241/183 X 3,467,321 9/1969 Tracheo et al. ..... 241/183

3,630,459 12/1971 Slegten ..... 241/183

3,677,479 7/1972 Slegten ..... 241/183

*Primary Examiner*—Howard N. Goldberg

*Attorney, Agent, or Firm*—Haseltine, Lake & Waters

[57] ABSTRACT

The liner covering the inner wall surface of the drum of a grinding mill comprises a plurality of rectangular lining units each having an inner working surface inclined to approach the drum centerline from its upstream end to its downstream end, the lining units being in mutual dispositions such that lining units which are mutually adjacent in the drum rotational direction are mutually staggered in the drum longitudinal direction, and each lining unit is provided at its leading side part in the rotational direction with a concavely curved guide surface joining in a continuously flush manner the inclined working surface of the adjacent lining unit in the rotational direction.

6 Claims, 15 Drawing Figures

LINER IN GRINDING MILL

BACKGROUND OF THE INVENTION

This invention relates generally to grinding mills (ball and tube mills) used for grinding materials such as raw material for cement and more particularly to liners of the inner surfaces of the shells or drums of grinding mills.

More specifically, the invention relates to a drum lining in a grinding mill which lining has a working surface of a unique shape such that the grinding media such as steel balls placed in the drum are positively classified by size from large-diameter grinding media to small-diameter grinding media successively disposed from the drum feed inlet end to the discharge outlet end.

In general, the drum of a grinding mill contains therein a great variety of grinding media (e.g., steel balls) of different sizes. It is desirable, in order to attain a high grinding efficiency, that these grinding media be distributed according to the particle size thereof successively from large grinding media at the mill feed inlet to small grinding media near the discharge outlet. In actual practice, however, this distribution sequence tends to be reversed because of the flow of the material being ground within the drum.

For this reason, in order to obtain the desired distribution of the grinding media, it has heretofore been the practice in a mill of the instant type to line the inner wall surface of the drum with numerous lining units having inclined surfaces which become higher from the mill feed inlet toward the discharge outlet. However, since these lining units are aligned in rows in the circumferential direction of the mill drum, ring-shaped shoulders or ledges are formed in the circumferential direction on the inner surface of the drum by the upper ends of the inclinations of these lining units. These ring-shaped shoulders obstruct the migration of the grinding media, particularly grinding media of large diameter, toward the mill feed inlet. For this reason, in grinding mills of these class known heretofore, the classification or sorting of the grinding media has been inadequate, whereby desirable grinding efficiencies could not be attained.

SUMMARY OF THE INVENTION

It is an object of this invention to provide, in a grinding mill, a lining adapted to facilitate the migration of the larger grinding media toward the mill feed inlet and functioning to effect positive and accurate classification or graduation of the grinding media by size thereby to afford a high grinding efficiency.

According to this invention, briefly summarized, there is provided, in a grinding mill of the class under consideration, a liner covering the inner wall surface of the mill drum and comprising a plurality of lining units, each having upstream and downstream ends respectively nearest the inlet and outlet ends of the drum and having an inner working surface inclined to progressively approach the drum axial centerline from its upstream end to the downstream end, the lining units being secured to the drum with mutual dispositions such that lining units which are mutually adjacent in the drum rotational direction are mutually staggered in the drum longitudinal direction, each lining unit being provided at its leading side part in the drum rotational direction with a guide surface joining in a continuously flush manner the inclined working surface of the adjacent lining unit in the drum rotational direction.

The nature, utility, and further features of this invention will be more clearly apparent from the following detailed description with respect to preferred embodiments of the invention when read in conjunction with the accompanying drawings, which are briefly described below, and throughout which like parts are designated by like reference numerals and characters.

DETAILED DESCRIPTION OF THE INVENTION

Figure 1:
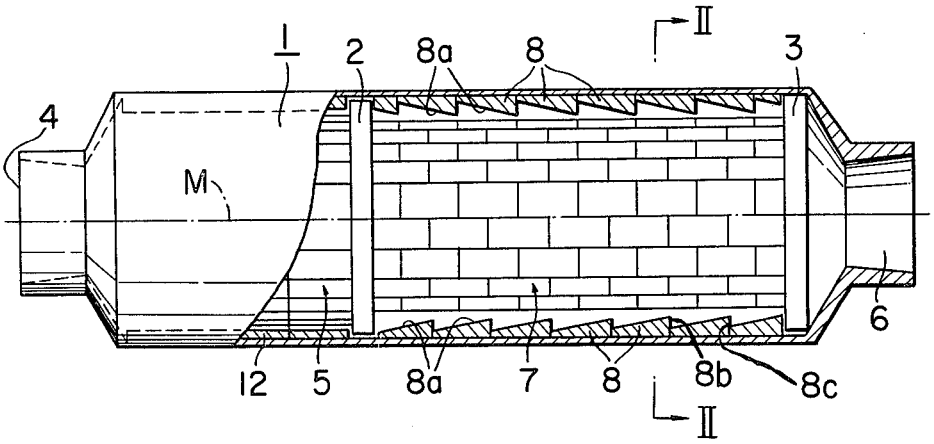
FIG. 1 is a side elevation, with parts cut away and parts shown in longitudinal section, showing a grinding mill drum provided with one example of a linear according to this invention.
Figure 2:
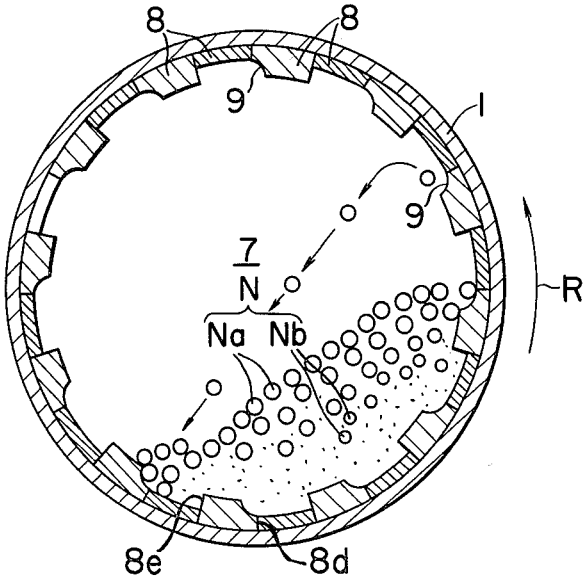
FIG. 2 is a cross section taken along the plane indicated by line II—II in FIG. 1 as viewed in the arrow direction.

Referring first to FIGS. 1 and 2, the mill shell or drum 1 shown therein has two partition walls 2 and 3 which divide the drum interior into a first grinding chamber 5 communicating with a feed inlet 4 and a second grinding chamber 7 on the side of a discharge outlet 6 disposed at the end of the drum opposite from the inlet 4. The partition walls 2 and 3 are of known slotted wall type functioning as sieves for the material being ground and, therefore, will not be described in detail. The drum 1 is adapted to rotate in the arrow direction R about the horizontal axial centerline M thereof.

The inner wall surface of the second grinding chamber 7 is lined with a liner comprising a plurality of lining units 8. As shown in FIGS. 3 through 6, the lining units 8 are of plate form having an inclined working surface $8_a$. The inclined surface $8_a$ of each lining unit 8 is inclined inward, that is, toward the drum centerline M, from its upstream edge or edge nearest the inlet 4 toward its downstream edge or edge nearest the outlet 6. The lining units 8 are disposed in straight rows parallel to the drum centerline M and, at the same time, the lining units in one row are staggered in the longitudinal direction relative to the lining units of the adjacent rows.

All of the lining units 8 are identical to each other and hence have corresponding parts which can be identified by the same or common reference characters. Therefore, when the lining units and their parts are to be referred to collectively or individually hereinafter in respect of the common features of the units, reference characters common to all of the lining units will be used. However, when describing relationships between adjoining lining units and between their parts, their common reference characters will be distinguished from each other by adding suffixes 1, 2 and 3 thereto. Under the above rule, suffixed reference characters appear in some of the figures of the drawings, but some of them will not be referred to individually, that is, with designation of suffixed reference characters, in the specification because what they mean will be self-explanatory on the basis of the above stated rule.

Figure 6:
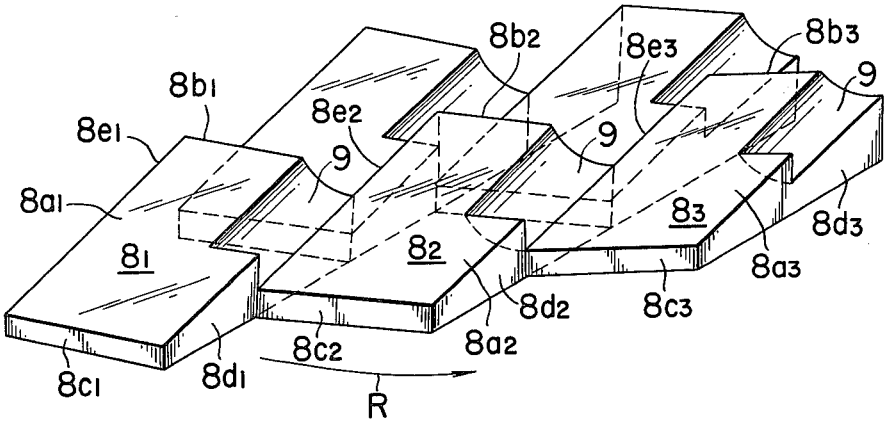
FIG. 6 is a relatively enlarged, fragmentary perspective view of the linear shown in FIGS. 3, 4, and 5.

As shown in FIG. 6, lining units $8_1$, $8_2$, and $8_3$, for example, in adjacent rows are staggered or successively disposed in mutually offset positions in the drum longitudinal direction so that the lower end part $8_{c2}$ ($8_{c3}$) of the inclined surface of one lining unit $8_2$ ($8_3$) is adjacent to a side part of the higher end part $8_{b1}$ ($8_{b2}$) of a lining unit $8_1$ ($8_2$) of an adjacent row. Furthermore, on one side part of the higher end part $8_b$ of each lining unit 8, there is formed a concavely curved guide surface 9 joining in a continuously flush manner the inclined surface $8_a$ at the lower end part $8_c$ of the adjacent lining unit 8 in the rotational direction R of the drum 1. In the instant example shown, the guide surfaces 9 are so concavely curved that the grinding media N within the drum 1 will be acted upon by these guide surfaces 9 and raised in the drum rotational direction R, as will be appreciated from the illustration in FIG. 2. Each lining unit 8 has a leading side face $8_d$ $8_{d2}$ or $8_{d3}$ facing the rotational direction of the mill drum and a trailing side face on the opposite side as shown in FIG. 6

Figure 4:
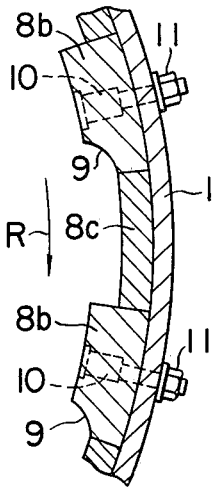
FIG. 4 is a cross section taken along the plane indicated by line IV—IV in FIG. 3 as viewed in the arrow direction.

The lining units 8 are secured to the inner surface of the drum 1 by bolts 10 and nuts 11 are shown in FIG. 4. The drum 1 at the aforementioned first grinding chamber 5 is lined with a liner 12 as shown in FIG. 1.

Figure 5:
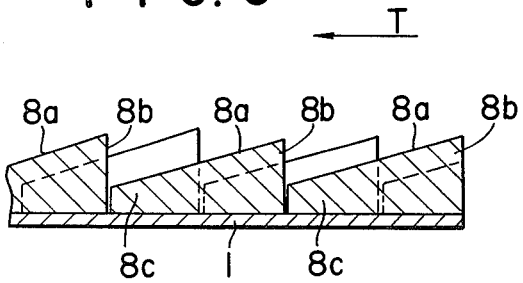
FIG. 5 is a longitudinal section taken along the plane indicated by line V—V as viewed in the arrow direction.

In the operation of the grinding mill with the liner of the above described construction according to this invention, as the mill drum 1 rotates in the arrow direction R, the grinding media N such as steel balls placed in the second grinding chamber 7 follow the lining units 8, thereby being lifted, and thereafter fall toward the bottom of the drum 1, as indicated in FIG. 2. As these grinding media N thus fall, they collide with the inclined surfaces $8_a$ of the lining units 8, thereby being caused to roll, and are subjected to a propelling force in the arrow direction T as shown in FIG. 5 toward the inlet 4.

In this case, in general, the grinding media $N_b$ (FIG. 2) of smaller diameter tend to burrow into the radially inner region of the mass of grinding media, while the grinding media $N_a$ of greater diameter tend to migrate to the radially outer surface of the mass. Consequently, the grinding media $N_a$ of greater diameter are subjected to a greater degree to the rolling-inducing action of the inclined surfaces $8_a$ of the lining units 8 than the grinding media $N_b$ of smaller diameter.

Figure 7:
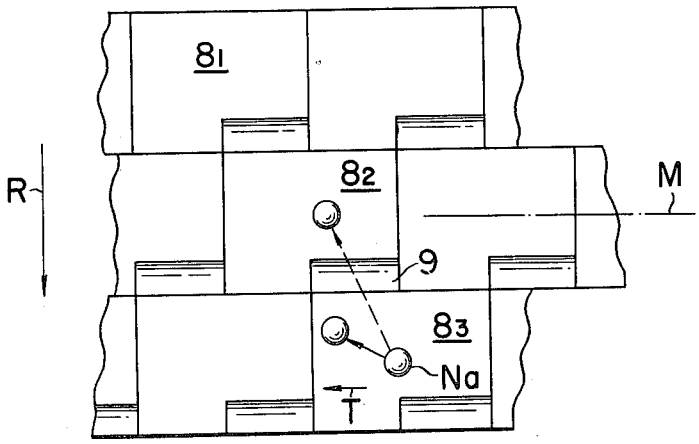
FIG. 7 is a relatively enlarged, fragmentary plan view for a description of the action of the lining units.

Each grinding media $N_a$ of large diameter subjected to a propelling force toward the inlet 4 rolls in an oblique direction relative to the centerline M of the drum as indicated in FIG. 7. Since the guide surface 9 of the adjacent lining unit 8 (for example, $8_2$) is disposed on one side of the lower end part of the inclined surface of each lining unit 8 (for example, $8_3$), a large-diameter grinding media $N_a$ on the guide surface 9 is guided by this guide surface 9 and thus rides onto the working surface of the adjacent lining unit 8 (for example, $8_2$). A large-diameter grinding media $N_a$ thus rolling on a lining unit 8 moves past the guide surface 9 and is transferred onto the succeeding lining unit 8 on the inlet side, thus migrating toward the inlet 4.

A grinding media which has rolled along the inclined surface of a lining unit 8, for example $8_3$, and, without being guided onto the lining unit $8_2$ adjacent to the first mentioned unit $8_3$ in the drum rotational direction, and has moved onto the lower end part of the inclined surface of the lining unit $8_3$ is arrested by the higher end part of the adjoining unit in the same row and lifted by the guide surface 9 of the lining unit $8_2$ and again tumbles downward. Then, if the grinding media falls onto the inclined surface of a lining unit disposed on the inlet side of the lining unit $8_3$, the inclined surface of that lining unit will impart to the grinding media a propelling force toward the mill inlet 4, and the grinding media can migrate progressively toward the inlet 4.

Thus, the large-diameter grinding media $N_a$ congregate on the side of the inlet 4, while the small-diameter grinding media $N_b$ migrate to the side of the outlet 6, whereby the grinding media N are classified by size, successively decreasing in size from the inlet 4 toward the outlet 6.

Figure 8:
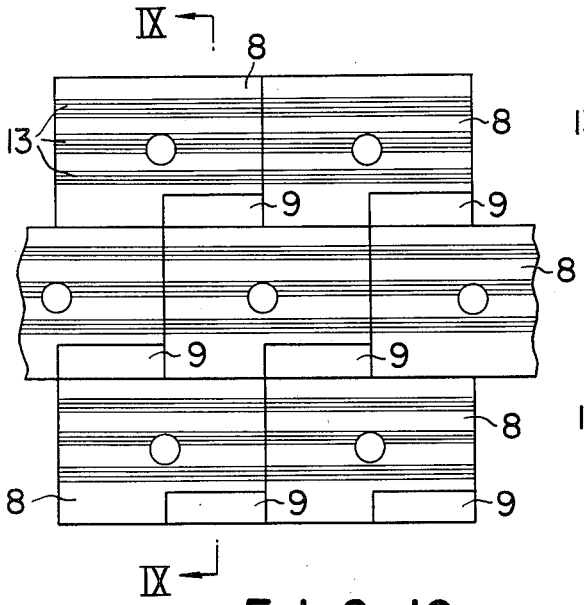
FIG. 8 is a relatively enlarged, fragmentary plan view showing another example of a liner according to the invention.
Figure 9:
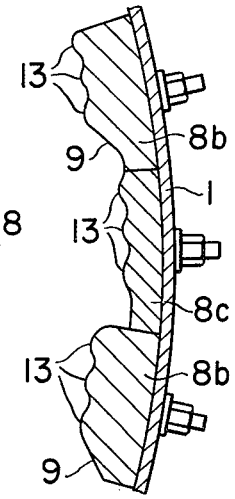
FIG. 9 is a cross section taken along the plane indicated by line IX—IX in FIG. 8 as viewed in the arrow direction.

While, in the above described example, the guide surface 9 is formed as a concavely curved surface carved into the lining unit 8 and functions to lift the grinding media N, the guide surface is not limited to such a curved surface but may be a flat inclined surface. Furthermore, as illustrated by another example of the lining according to this invention as shown in FIGS. 8 and 9, each lining unit 8 has on its inclined surface part an undulating or wavy surface with a plurality of crests 13 to function as lifters. By the provision of these lifters 13, not only is the action of lifting the grinding media N maintained, but the wear of the liners 8 is reduced.

Figure 3:
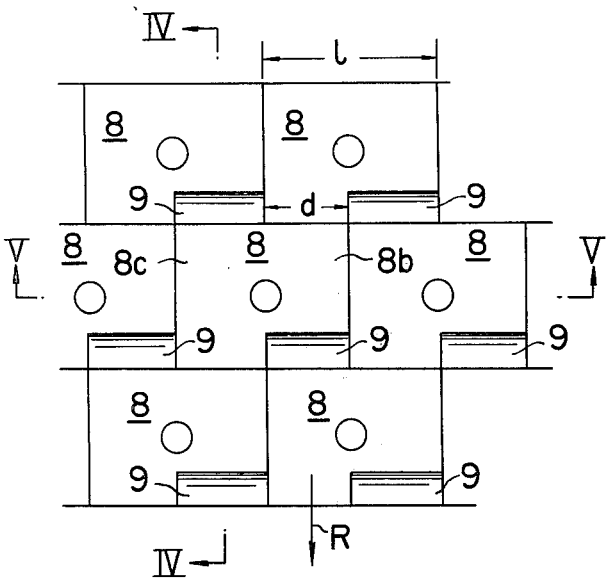
FIG. 3 is a relatively enlarged, fragmentary plan view of the drum liner.

Furthermore, in the example illustrated in FIG. 3, the staggering distance d of the rows of the lining units 8 is made to be one half of the length l of each lining unit 8 in the drum longitudinal direction, but this staggering distance d need not be thus limited and can be freely selected.

Figure 10:
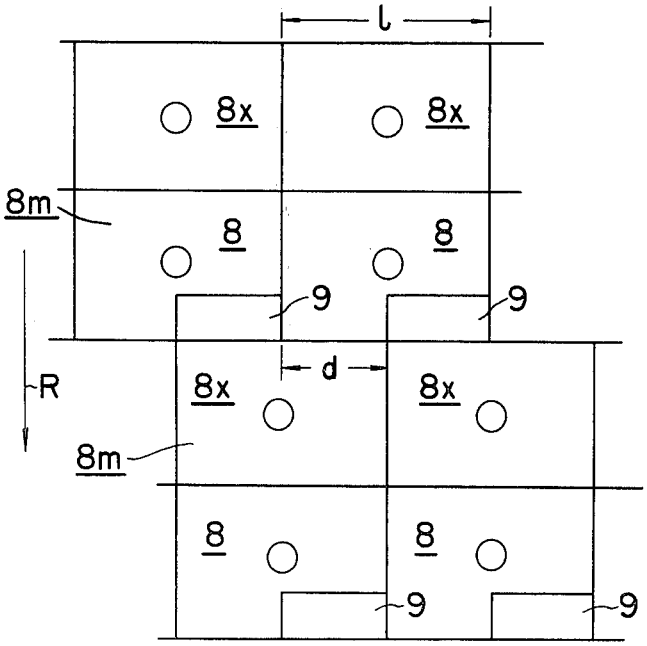
FIG. 10 is a relatively enlarged, fragmentary plan view of still another example of the liner according to the invention.
Figure 11:
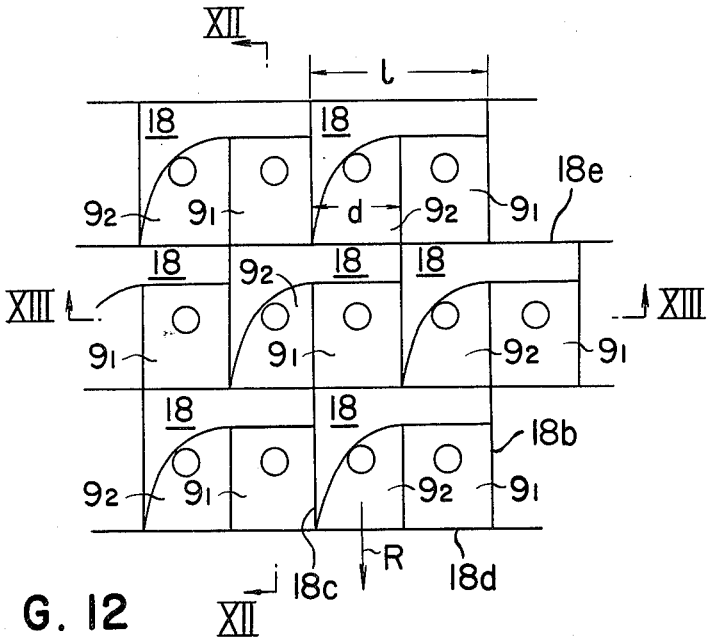
FIG. 11 is a relatively enlarged, fragmentary plan view showing still another example of the drum liner according to the invention.
Figure 12:
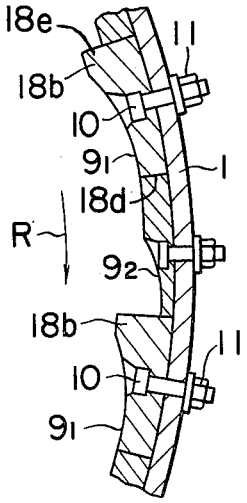
FIG. 12 is a cross section taken along the plane indicated by line XII—XII in FIG. 11.
Figure 13:
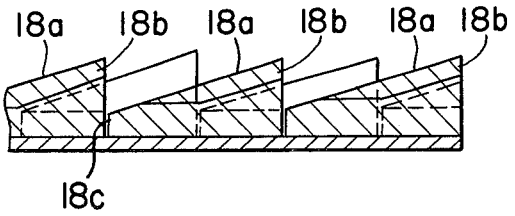
FIG. 13 is a longitudinal section taken along the plane indicated by line XIII—XIIi in FIG. 11.
Figure 14:
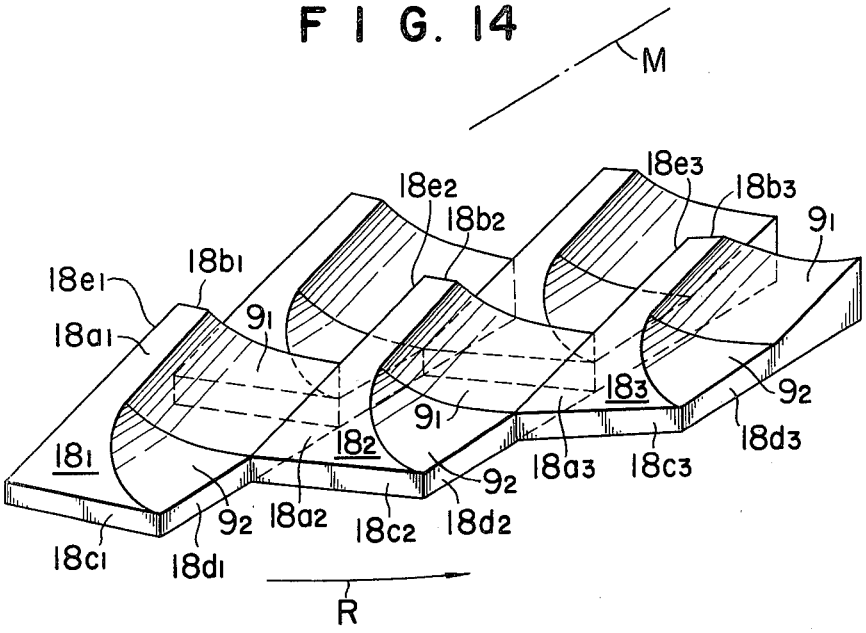
FIG. 14 is a relatively enlarged, fragmentary perspective view of the liner shown in FIGS. 11 through 13.

In the example illustrated in FIG. 10, one liner group $8_m$ is constituted by two lining units 8 and $8_x$ (more than three may be used) which are adjacent in the drum rotational direction R. The staggering distance d in the drum longitudinal direction between these two lining units 8 and $8_x$ is made zero, and the liner group $8_m$ is staggered in the drum longitudinal driection relative to another liner group adjacent thereto in the drum rotational direction. In this example, the guide surface 9 is provided on only each of the lining units 8 disposed in the forward or leading position in the drum rotational direction.

In the liner according to this invention as described above, each lining unit is provided with a guide surface for guiding grinding media rolling thereto from another lining unit staggered toward the mill discharge outlet, at the forward or leading part in the drum rotational direction of the lining unit. Accordingly, the large-diameter grinding media rolling over the lining units under a great propelling force toward the inlet side are guided by these guide surfaces, thereby being transferred by successively riding onto the surface of the lining units respectively on the inlet side and rapidly collecting on the inlet side. As a result, classification of the grinding media within the grinding chamber is carried out positively and accurately, whereby the grinding efficiency rises.

Furthermore, since the guide surface can be formed by carving out one portion of the corresponding lining unit, the weight of the lining unit can be reduced, and this contributes to the reduction of weight of the entire grinding mill.

In still another embodiment of this invention as illustrated in FIGS. 11 through 15, the staggered arrangement of the lining units 18 is similar to that of the preceding examples, but the shape of the working surface of each lining unit 18 is different as described below.

Each lining unit 18 has an inclined surface $\mathbf{18}_a$, $\mathbf{18}_{a1}$, $\mathbf{18}_{a2}$, or $\mathbf{18}_{a3}$ and higher and lower end parts $\mathbf{18}_b$, $\mathbf{18}_{b1}$, $\mathbf{18}_{b2}$ or $\mathbf{18}_{b3}$ and $\mathbf{18}_c$, $\mathbf{18}_{c1}$, $\mathbf{18}_{c2}$ or $\mathbf{18}_{c3}$ of the inclined surface similarly as in the preceding examples. On one side part of the higher end part $\mathbf{18}_b$ of each lining unit, there is formed a concavely curved guide surface $\mathbf{9}_1$ joining in a continuously flush manner the inclined surface $\mathbf{18}_a$ of the lower end part $\mathbf{18}_c$ of the adjacent lining unit 18 in the drum rotational direction R. This curved guide surface $\mathbf{9}_1$ is greater in area than the aforedescribed guide surface 9 relative to the planar area of the entire lining unit. In addition, another concavely curved guide surface $\mathbf{9}_2$ joining in a continuously flush manner the guide surface $\mathbf{9}_1$ and extending therefrom to the lower end part $\mathbf{18}_c$ is formed in the lining unit 18.

The guide surfaces $\mathbf{9}_1$ and $\mathbf{9}_2$ are so concavely curved that the grinding media N are lifted in the drum rotational direction R and caused to roll downward as described hereinbefore with reference to FIG. 2. The guide surface $\mathbf{9}_2$ is formed as an extension of the guide surface $\mathbf{9}_1$ and, moreover, in parallelism with the drum centerline M. In the example illustrated in FIGS. 11 through 15, more than one half (approximately two thirds) of the area of each lining unit 18 as viewed in plan view is occupied by the guide surfaces $\mathbf{9}_1$ and $\mathbf{9}_2$.

Figure 15:
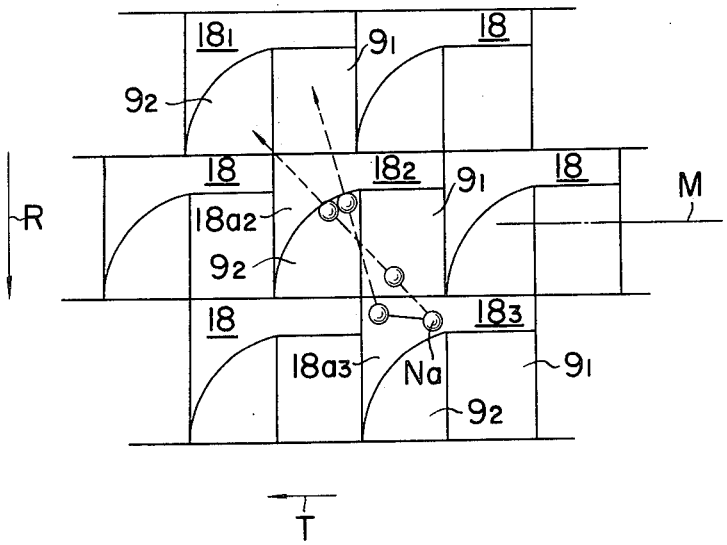
FIG. 15 is a fragmentary plan view for a description of the action of the liner illustrated in FIGS. 11 through 14.

Referring to FIG. 15, a large-diameter grinding media $N_a$ on the inclined surface $\mathbf{18}_{a3}$ of a lining unit $\mathbf{18}_3$, for example, rolls onto the guide surface $\mathbf{9}_1$ of the adjacent lining unit $\mathbf{18}_2$ and over the guide surface $\mathbf{9}_2$ and then, riding onto the inclined surface $\mathbf{8}_{a2}$ of the lining unit $\mathbf{18}_2$, migrates over the guide surfaces $\mathbf{9}_1$ and $\mathbf{9}_2$ of the succeeding adjacent lining unit $\mathbf{18}_1$. In another possible path, the large-diameter grinding media $N_a$ first rolls along the inclined surface $\mathbf{18}_{a3}$ and then, passing over the guide surfaces $\mathbf{9}_1$ and $\mathbf{9}_2$, migrates successively toward the inlet 4 similarly as in the preceding examples.

In the instant example, as described above, the guide surfaces $\mathbf{9}_1$ and $\mathbf{9}_2$ are carved into the lining unit 18 as concavely curved surfaces such as to lift the grinding media N, but these guide surfaces may be flat inclined surfaces. Furthermore, while the guide surface $\mathbf{9}_2$ is formed as a surface parallel to the drum centerline M, it is not necessarily limited to such a shape.

Furthermore, in the instant example, the leading side part $\mathbf{18}_d$ $\mathbf{18}_{d1}$, $\mathbf{18}_{d2}$ or $\mathbf{18}_{d3}$ in the drum rotational direction R of each lining unit 18 is abuttingly adjacent to the opposite (or trailing) side parts of the adjacent lining units 18 in the drum rotational direction R, similarly as in the preceding examples. The other features of construction and function are the same as those of the preceding examples.

According to the instant embodiment of this invention, the upstanding wall between the lowest part of the guide surface 9 and the inclined surface of the lining unit 8 of the preceding examples is removed, so that smoother movement of the grinding media toward the lower end part of each lining unit than in the preceding examples is assured.

What is claimed is:

1. In a grinding mill of the class comprising a mill drum having a material feed inlet and discharge outlet and driven in rotation about the axial centerline thereof and grinding media of various sizes accommodated within the drum, the combination therewith of a liner covering the inner wall surface of the drum and comprising a plurality of lining units, each of which has upstream and downstream ends respectively nearest said inlet and outlet and has an inner working surface inclined to progressively approach said centerline from the upstream end to the downstream end, the lining units being secured to the drum with mutual dispositions such that lining units which are mutually adjacent in the drum rotational direction are mutually staggered in the drum longitudinal direction, each lining unit being provided at its leading side part in the drum rotational direction and toward its downstream end part with a guide surface joining in a continuously flush manner the inclined working surface of the adjacent lining unit in the rotational direction.

2. A liner as claimed in claim 1 in which the inclined working surface of each lining unit is formed to have a lifting action with respect to the grinding media.

3. A liner as claimed in claim 1 in which the inclined working surface of each lining unit has undulations of crests and troughs substantially parallel to said centerline.

4. A liner as claimed in claim 1 in which said guide surface of each lining unit comprises first and second surface parts, of which the first surface part begins at said downstream end, and extends toward said upstream end to join in a continuously flush manner the second surface part, which extends further toward said upstream end and, moreover, is parallel to said centerline.

5. A liner as claimed in claim 1 or 4 in which said guide surface is a concavely curved surface.

6. In a grinding mill of the class comprising a mill drum having a material feed inlet and discharge outlet and driven in rotation about the axial centerline thereof and grinding media of various sizes accommodated within the drum, the combination therewith of a liner covering the inner wall surface of the drum and comprising a plurality of lining units, each of which has upstream and downstream ends respectively nearest said inlet and outlet and has an inner working surface inclined to progressively approach said centerline from the upstream end to the downstream end, the lining units being secured to the drum in groups each of a plurality of lining units aligned in tandem in the rotational direction without mutual stagger, the groups being so arranged that groups which are mutually adjacent in the rotational direction are mutually staggered in the drum longitudinal direction, the leading lining unit in the rotational direction of each group being provided at its leading side part with a guide surface joining in a continuously flush manner, the inclined working surface of the adjacent lining unit in the rotational direction.

* * * * *